US006276925B1

(12) United States Patent
Varga

(10) Patent No.: US 6,276,925 B1
(45) Date of Patent: Aug. 21, 2001

(54) CANDLE AND METHOD OF MAKING THE SAME

(76) Inventor: Charles L. Varga, 4871 Warner Rd., Westerville, OH (US) 43081

( * ) Notice: Subject to any disclaimer, the term of this patent is extended or adjusted under 35 U.S.C. 154(b) by 0 days.

(21) Appl. No.: 09/637,721

(22) Filed: Aug. 11, 2000

(51) Int. Cl.[7] ..... C11C 5/00
(52) U.S. Cl. ..... 431/288; 44/275
(58) Field of Search ..... 431/126, 288; 425/803; 44/275

(56) References Cited

U.S. PATENT DOCUMENTS

| | | | | |
|---|---|---|---|---|
| 1,709,889 | * | 4/1929 | Tasker | 431/126 |
| 2,001,312 | | 5/1935 | O'Connell . | |
| 3,283,546 | * | 11/1966 | Matsui | 431/126 |
| 3,428,409 | | 2/1969 | Summers . | |
| 3,586,473 | * | 6/1971 | Galloway et al. | 431/126 |
| 3,773,460 | | 11/1973 | Tellier . | |
| 4,507,077 | * | 3/1985 | Sapper | 431/288 |
| 4,696,640 | * | 9/1987 | Pitchford | 431/289 |
| 5,395,233 | * | 3/1995 | Karp | 431/126 |
| 5,632,615 | | 5/1997 | DeGarmo . | |

FOREIGN PATENT DOCUMENTS

| | | | | |
|---|---|---|---|---|
| 2149690 | * | 3/1973 | (FR) | 431/289 |
| 8048992 | | 2/1996 | (JP) . | |

OTHER PUBLICATIONS

Raven Norejko, Homemade Designer Candles (the easy way . . . ) [online], [retrieved on Dec. 14, 1999]. Retrieved from the Internet: <URL:http://www.makestuff.com/wallpaper_candles.html>.*

* cited by examiner

*Primary Examiner*—Sara Clarke
(74) *Attorney, Agent, or Firm*—Porter, Wright, Morris & Arthur LLP

(57) ABSTRACT

A candle is provided having an inner core with a top end, a bottom end, an outer surface, and a wick; a middle layer attached to said outer surface of said inner wax core; and an outer layer attached to said middle layer. The middle layer of the candle is a foil sheet with designs cut into the sheet. The candle has a translucent inner core and an opaque middle layer. The outer layer has an opacity such that the middle layer is visible only when said wick is lit. The outer layer and the middle layer of the candle have a melting point higher than the melting point of the inner core. A method for making the candle is also provided.

13 Claims, 4 Drawing Sheets

CANDLE AND METHOD OF MAKING THE SAME

BACKGROUND OF THE INVENTION

The present invention relates generally to candles and, more particularly, to decorative candles.

Many varieties of decorative candles have been produced. Different techniques have been used to provide a decorative appearance to these candles. One such technique involves placing a candle in a decorated votive. However, this involves using a candle along with an additional, and usually glass, votive. This method produces a heavy candle with the added cost of the additional material for the votive. Other techniques for producing decorative candles include placing flowers, herbs, candies, rocks, coffee beans, or other items within the outer portion of the candle so that they are visible as decoration. The decorative features of such candles and others have become usual and common. A need exists for a candle without a votive having unique decorative features.

SUMMARY OF THE INVENTION

The present invention provides a candle and method of making the same that overcomes at least some of the above-noted problems of the prior art. According to the present invention, a candle is provided having an inner core with a top end, a bottom end, an outer surface, and a wick. A middle layer is attached to the outer surface of the inner core and an outer layer is attached to the middle layer.

A method of making the candle is provided wherein an inner wax core with a top end, a bottom end, an outer surface, and a wick is provided. A middle layer is attached to the outer surface of the inner wax core and an outer wax layer is adhered to the middle layer.

These and further features and advantages of the invention will become apparent from the following detailed description and drawings.

It should be understood that the appended drawings are not necessarily to scale, presenting a somewhat simplified representation of various preferred features illustrative of the basic principles of the invention.

DETAILED DESCRIPTION OF CERTAIN PREFERRED EMBODIMENT(S)

Figure 1:
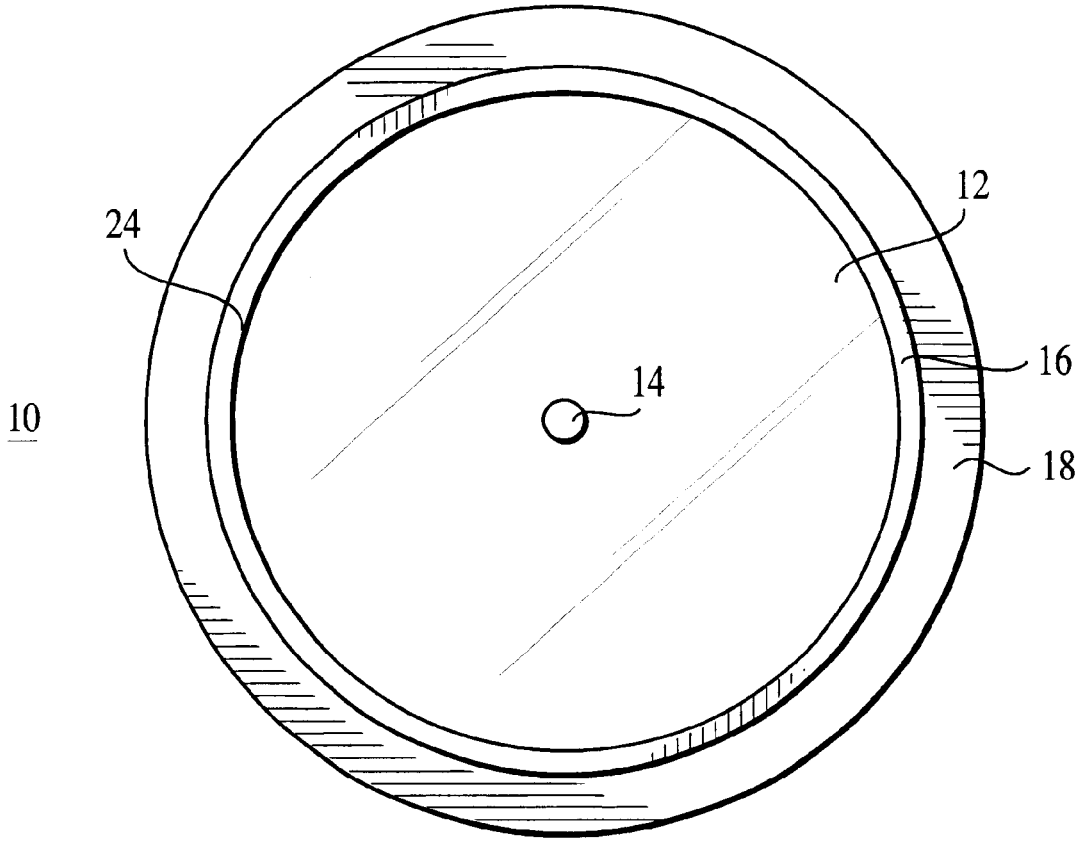
FIG. 1 is a top view of a candle according to the present invention.
Figure 2:
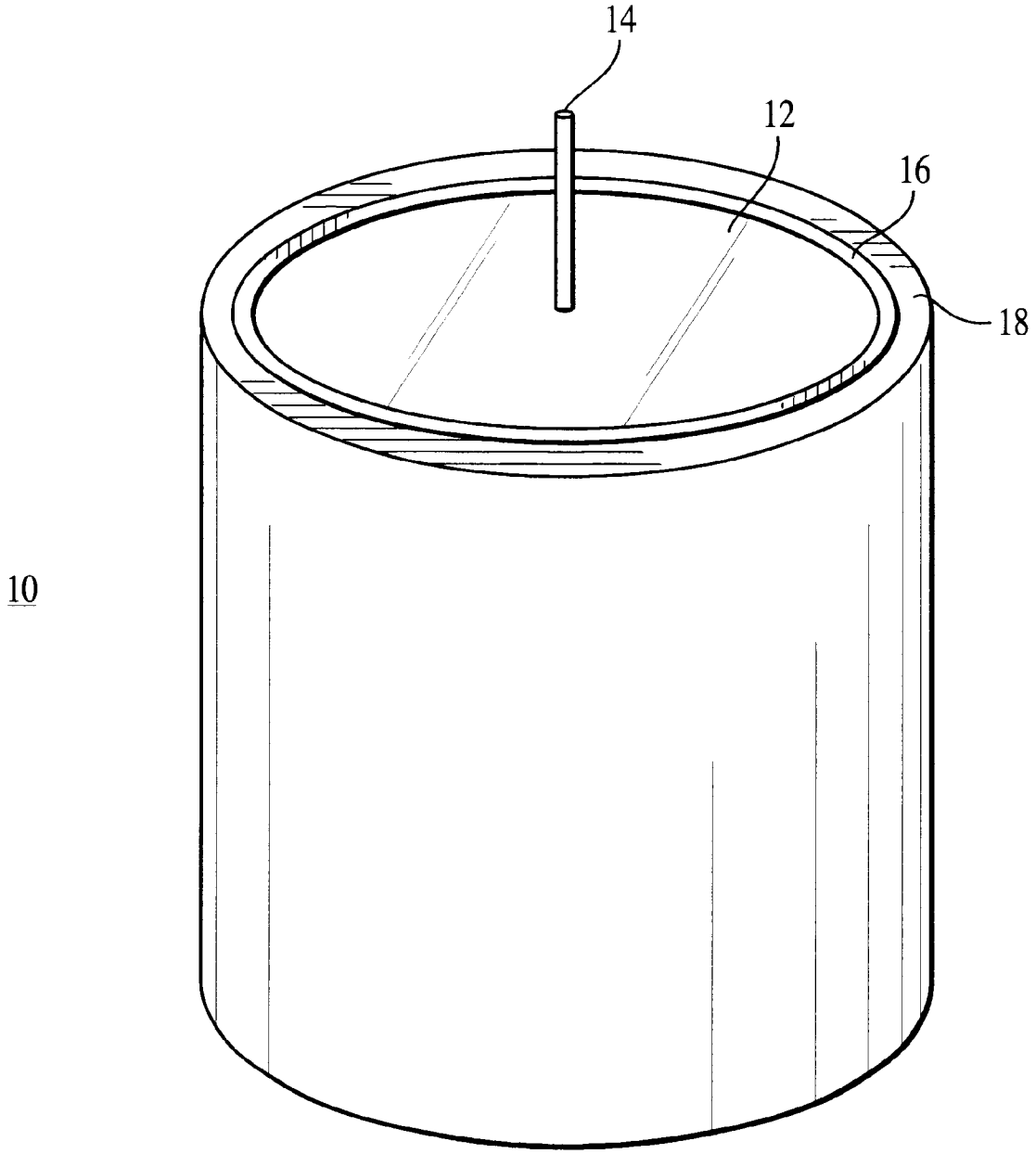
FIG. 2 is a perspective view of an unlit candle according to the present invention.
Figure 3:
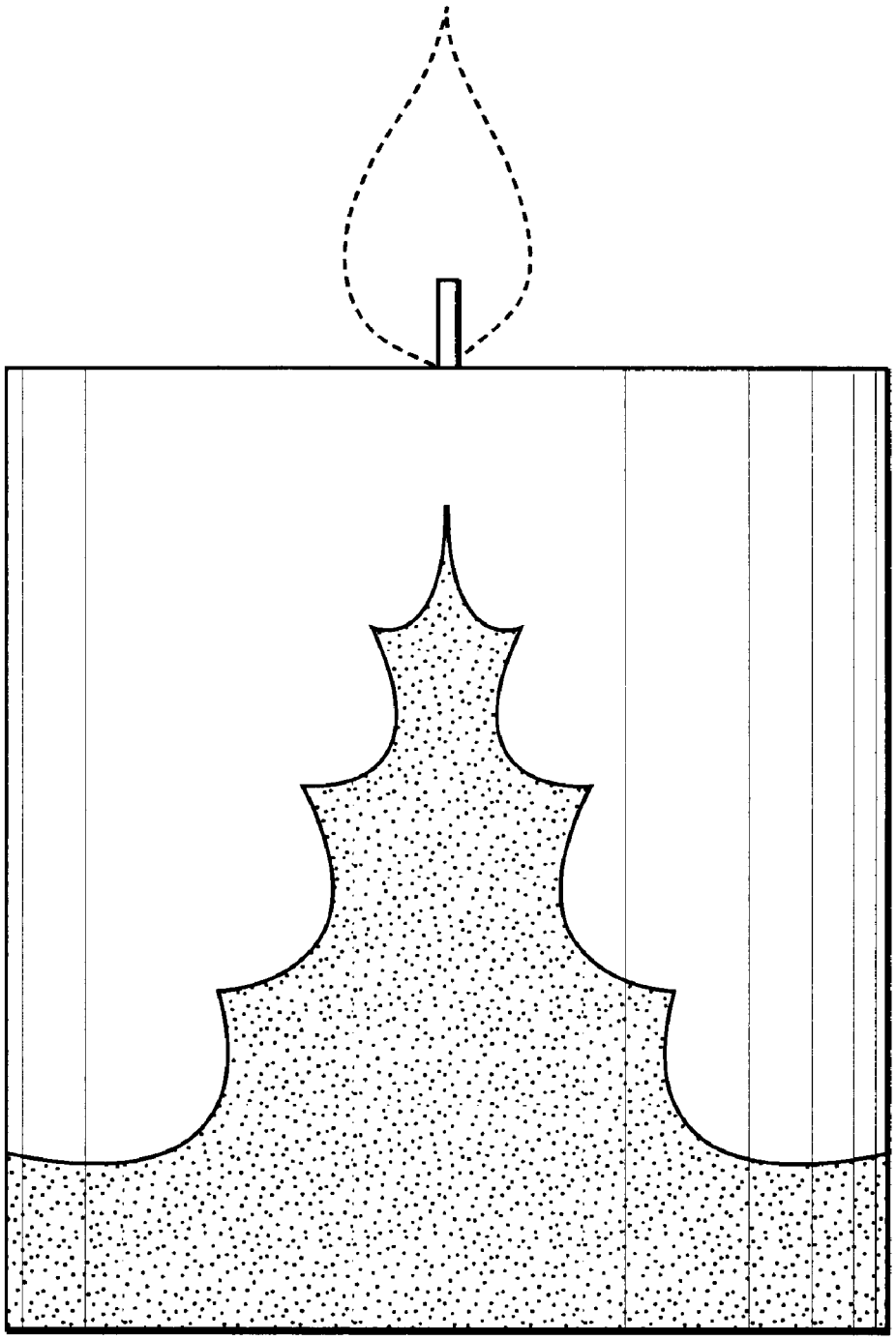
FIG. 3 is a side view of a lit candle according to the present invention.

As illustrated in FIGS. 1–3, a candle 10 is provided having a decorative image that is visible only when the candle is lit. While the illustrated embodiments of the present invention are particularly adapted for use in a cylindrical candle, it is noted that the present invention can be utilized with any other type of candle. Other embodiments and design variations will be apparent to those skilled in the art given the benefit of this disclosure.

Figure 2A:
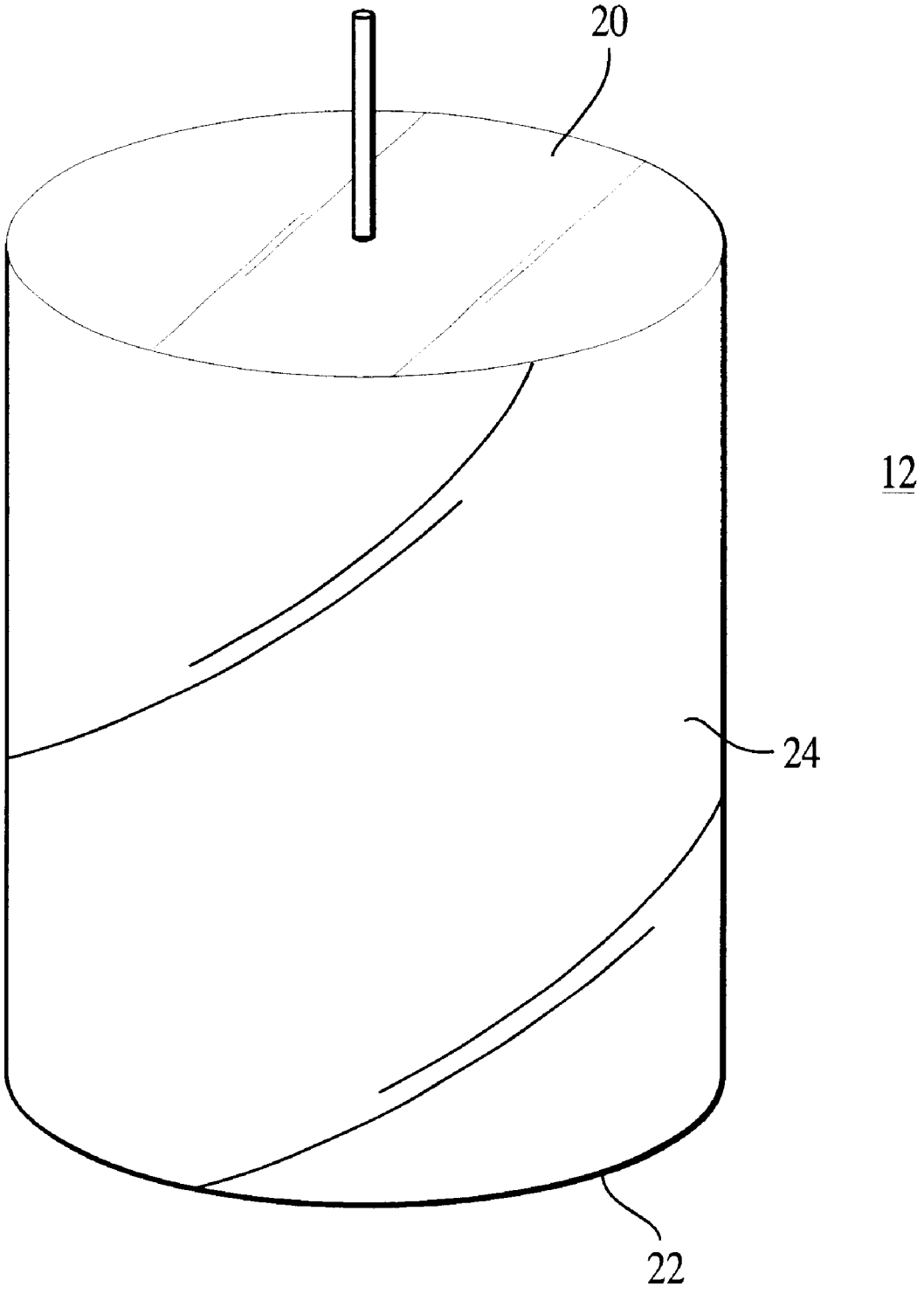
FIG. 2A is a perspective view of the core of the candle of FIG. 2.

With reference to FIGS. 1, 2, and 2A, the candle 10 is comprised of an inner core 12; a wick 14; a middle layer 16; and an outer layer 18. In the preferred embodiment, the inner core 12 has a wick 14, a top end 20, a bottom end 22, and an outer surface 24. The inner core 12 is preferably translucent and made of wax. The inner core 12 also preferably has a diameter between 2.5 inches and 3.5 inches.

In the preferred embodiment, the middle layer 16 is a foil sheet having designs cut into the sheet. For example, in a candle in accordance with the present invention and having a Christmas theme, the middle layer 16 may be a foil sheet having a Christmas tree design. The middle layer 16 is preferably opaque, but may be translucent. In an alternative embodiment in which the middle layer 16 is translucent, the middle layer 16 may comprise varying colors in order to achieve a colored design visible when the candle 10 is lit. In the preferred embodiment, the middle foil layer 16 is an aluminum foil soft with a gauge between about 0.004 mils and about 0.006 mils, with an optimum thickness of 0.005 mils. It is noted that even though a foil sheet is used in the preferred embodiment, any other material that can be placed around the inner core 12 that will not bend into the flame of the candle 10 as the inner core 12 melts, such as high melt temperature plastic, may be used for the middle layer 16.

In another alternative embodiment, an aluminum foil thinner than about 0.004 mils may be used when a thin wax is coated over the foil layer 16 before the outer layer 18 is adhered, as described more fully below, by pouring wax in a mold around the inner core 12 and foil 16.

In yet another alternative embodiment, the middle layer 16 is comprised of a translucent card stock that may be colored in various places. Using this design, a colored design is visible from the outer layer 18 when the wick 14 is lit. The card stock may be different colors in different areas to produce a multi-colored design. In addition, when the light from the flame passes through the colored card stock middle layer 16, the resultant color visible on the outer layer 18 will depend upon the color of the card stock and the color of the outer layer 18. For example, if a red-colored card stock middle layer 16 is used with a blue-colored outer layer 18, the image that is visible will be purple-colored.

In the preferred embodiment, the outer layer 18 is comprised of a formulated wax having an opacity such that the middle layer 16 is visible only when the wick 14 is lit, as illustrated in FIG. 3. When the candle 10 is unlit, as illustrated in FIG. 2, and the candle 10 is in ordinary lighted conditions without the presence of a light source placed directly adjacent to the candle 10, the opacity of the outer layer 18 prevents the middle layer 16 from being perceptible through the outer layer 18.

The exact opacity range to be used in the outer layer will depend on several factors such as wick size (i.e., brightness of wick when lit), size and opacity of the translucent inner core 12, and width of the outer layer 18. A standard wick size/candle diameter ratio range, which is known to those skilled in the art, is used to determine the wick size of the inner core 12. (Candle cores with a wick size/candle diameter ratio above this range will burn so as to produce black smoke. Candle cores with a wick size/candle diameter ratio below this range will be put out from the melted wax.). Therefore, as long as the middle core 12 is translucent enough to allow light from the wick 14 to reach the outer layer 18, the prevailing factor that will determine the opacity of the outer layer 18 is the minimum opaqueness needed to hide the middle layer 16 when the candle 10 is not lit. The opacity of the outer layer 18 will have to be opaque enough to hide the middle layer 16 when the candle 10 is unlit yet be translucent enough to allow light from the wick 14 to pass through the outer layer 18 and reveal the middle layer 16 when the candle 10 is lit.

In the preferred embodiment of the invention, the outer layer 18 of the candle 10 is comprised of the following: (1) wax with a minimum melting point of 155° Fahrenheit; (2) 2 tablespoons Clear Sheen produced by The Barker Company (a wax hardener with a melting point of 215° Fahrenheit that does not affect opacity) per pound of wax; (3) ½ teaspoon stearic acid (a wax hardener) per 2 pounds wax; (4) 1 ounce of Micro 180 (a hard and refined wax with a melting point of 180° Fahrenheit that holds fragrance in wax) per two pounds wax. Color may also be added to the outer layer 18 during its preparation. The darker the outer layer 18 is due to the color added, the less visible the middle layer 16 will become. However, color is not necessary to achieve the result of having a foil layer 16 that is visible only when the candle 10 is lit. It will be appreciated by one skilled in the art that other variations of the outer layer, such as, for example, by varying the composition of the outer layer 18 to include a uvc inhibitor to prevent the wax color from fading, are included in the present invention.

In one alternative embodiment, the inner core 12 is comprised of a colored wax and the outer layer 18 is comprised of a white-colored wax. Using this design, the candle 10 appears white when it is unlit. When the candle 10 is lit, however, the candle appears colored (in a similar color to that of the core 12) in those areas where light from the flame passing through the colored core 12 reaches the outer layer 18 through holes in the middle foil layer 16.

The thickness of the outer layer 18 in the preferred embodiment is 0.25 inches. An outer layer 18 of less than 0.25 inches would result in a visible foil layer 16 when the candle 10 is unlit. An outer layer 18 of more than 0.25 inches would result in lowered clarity of the image created by the foil layer 16, but would still produce the effect of hiding the middle layer 16 when the candle 10 is unlit.

In the preferred embodiment, the outer layer 18 and the middle layer 16 both have a melting point higher than the inner core 12. It is also preferably that the melting point of the outer layer 18 and the middle layer 16 both have a melting point such that they will not melt or fold into the flame of the candle 10. This allows the candle 10 to bum, melting the inner core 12, while leaving the middle layer 16 and the outer layer 18 substantially intact.

The present invention also includes a method of making a candle 10. In the preferred method of making a candle 10, an inner wax core 12 is provided that is sized to fit into a mold for pouring the outer layer 18. Preferably, a specific foil sheet 16 is designed to fit around the outer tubular surface 24 of the inner core 12 of the cylindrical candle 10. In the preferred embodiment, the middle layer 16 (foil sheet) is wrapped around the outer surface 24 of the inner core 12 of the cylindrical candle 10 and is attached by using a high melt temperature glue. The glue is preferably allowed to dry before the outer layer 18 is adhered. Preferably, the inner core 12 with attached foil sheet 16 is centered in a tubular mold leaving a specified distance between the outer surface 24 of the inner core 12 and the inner surface of the mold. The outer wax layer 18 is preferably formed by adding a formulated wax (such as that described above) to the mold and allowing it to dry, thereby adhering the outer layer 18 to the foil sheet 16 and any exposed portions of the outer surface 24 of the inner core 12 not covered by the foil sheet 16. Preferably, the outer layer 18 is allowed to cool at room temperature until there is little or no movement of the wax, at which time the candle 10 is cooled in a cooling chamber so as to prevent shrinking of the candle 10. Other variations of the method described, such as, for example, by varying the particular way the middle 16 and outer 18 layers are attached or by varying the shape of the wax mold, are included in the present invention.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the invention discussed herein in connection with a cylindrical candle can be utilized with any other shape of candle. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A candle comprising:

an inner core having a top end, a bottom end, an outer surface, and a wick;

a middle layer attached to said outer surface of said inner core; and an outer layer attached to said middle layer;

wherein said middle layer is a foil sheet with designs cut into the sheet.

2. The candle of claim 1 wherein the inner core and the outer layer are comprised of wax; said inner core is translucent; said middle layer is opaque; said outer layer has an opacity such that the middle layer is visible only when said wick is lit; and said outer layer and said middle layer have a melting point higher than said inner core.

3. A candle comprising:

an inner core having a top end, a bottom end, an outer surface, and a wick;

a middle layer attached to said outer surface of said inner core; and an outer layer attached to said middle layer;

wherein said inner core is translucent and said outer layer has an opacity such that the middle layer is visible only when said wick is lit.

4. The candle of claim 3 wherein said middle layer is opaque.

5. The candle of claim 3 wherein said middle layer is translucent.

6. The candle of claim 3 wherein the inner core and the outer layer are comprised of wax; said middle layer is translucent; and said outer layer and said middle layer have a melting point higher than said inner core.

7. A method of making a candle comprising:

providing an inner wax core having a top end, a bottom end, an outer surface, and a wick;

attaching a middle layer to said outer surface of said inner wax core;

adhering an outer wax layer to said middle layer;

wherein the step of adhering an outer wax layer comprises:

placing said inner wax core with said middle layer attached to said outer surface of said inner wax core into a mold;

pouring a wax mixture into said mold;

cooling the wax mixture.

8. The method of claim 7 wherein:

the middle layer of said candle is a foil sheet;

the step of attaching a middle layer comprises attaching the foil sheet around said outer surface of said inner wax core with glue;

said inner wax core is translucent, said middle layer is opaque, said outer wax layer has an opacity allowing the middle layer to be visible only when said wick is lit, and said outer wax layer and said middle layer have a melting point higher than said inner wax core.

9. A method of making a candle comprising:

providing an inner wax core having a top end, a bottom end, an outer surface, and a wick;

attaching a middle layer to said outer surface of said inner wax core;

adhering an outer wax layer to said middle layer;

wherein the middle layer of said candle is a foil sheet with designs cut into said sheet.

10. The method of claim 9 wherein the step of attaching a middle layer comprises:

attaching the foil sheet around said outer surface of said inner wax core with glue.

11. A method of making a candle comprising:

providing an inner wax core having a top end, a bottom end, an outer surface, and a wick;

attaching a middle layer to said outer surface of said inner wax core;

adhering an outer wax layer to said middle layer;

wherein said inner wax core is translucent and said outer wax layer has an opacity such that the middle layer is visible only when said wick is lit.

12. The method of claim 11 wherein said middle layer is opaque.

13. The method of claim 11 wherein said middle layer is translucent.

* * * * *